US009574386B2

(12) United States Patent
Hillgaertner et al.

(10) Patent No.: US 9,574,386 B2
(45) Date of Patent: Feb. 21, 2017

(54) OPENING APPARATUS FOR A TAILGATE OF A MOTOR VEHICLE

(71) Applicant: Dr. Ing. h.c. F. Porsche Aktiengesellschaft, Stuttgart (DE)

(72) Inventors: Klaus Hillgaertner, Wurmberg (DE); Sven Just, Flein (DE)

(73) Assignee: DR. ING. H.C.F. PORSCHE AKTIENGESELLSCHAFT, Stuttgart (DE)

( * ) Notice: Subject to any disclaimer, the term of this patent is extended or adjusted under 35 U.S.C. 154(b) by 0 days.

(21) Appl. No.: 15/005,051

(22) Filed: Jan. 25, 2016

(65) Prior Publication Data

US 2016/0215551 A1 Jul. 28, 2016

(51) Int. Cl.

| | |
|---|---|
| ***E05F 5/02*** | (2006.01) |
| ***E05F 3/18*** | (2006.01) |
| ***E05F 3/16*** | (2006.01) |

(52) U.S. Cl.

CPC .. *E05F 3/18* (2013.01); *E05F 3/16* (2013.01)

(58) Field of Classification Search

CPC .. Y10T 16/625; Y10T 16/628; Y10T 16/6285; Y10T 16/5383; E05F 5/00; E05F 5/003; E05F 5/06; E05F 5/08; E05F 5/10; E05F 5/022; E05F 3/00; E05F 3/14; E05F 3/16; E05F 3/18; E05F 3/102; E05Y 2900/54; E05Y 2900/548; E05Y 2201/21; E05Y 2201/264; E05Y 2201/266

See application file for complete search history.

(56) References Cited

U.S. PATENT DOCUMENTS

| | | | | |
|---|---|---|---|---|
| 2,814,067 | A * | 11/1957 | Bowden | E05F 5/02 16/57 |
| 4,426,752 | A * | 1/1984 | Nakayama | E05F 3/14 16/82 |
| 6,039,388 | A * | 3/2000 | Choi | E05F 5/022 16/86 R |
| 6,408,483 | B1 * | 6/2002 | Salice | E05F 5/02 16/82 |
| 6,846,053 | B2 * | 1/2005 | Salice | A47B 88/047 312/334.14 |
| 7,032,271 | B2 * | 4/2006 | Lin | E05F 5/02 16/82 |
| 7,207,087 | B2 * | 4/2007 | Salice | E05F 5/006 16/374 |

(Continued)

FOREIGN PATENT DOCUMENTS

| | | |
|---|---|---|
| DE | 102 10 917 | 11/2003 |
| DE | 10 2005 044 436 | 3/2007 |
| DE | 10 2011 053 331 | 3/2013 |

OTHER PUBLICATIONS

German Search Report of Oct. 16, 2005.

*Primary Examiner* — Chuck Mah

(74) *Attorney, Agent, or Firm* — Gerald E. Hespos; Michael J. Porco; Matthew T. Hespos

(57) ABSTRACT

A tailgate of a motor vehicle has an opening apparatus configured to avoid overshooting during opening of the tailgate. The opening apparatus is connected to a silicone damper to bring about a damping action in the opening direction and a freewheeling action in the closing direction. Additionally, the opening apparatus is configured so that closing of the tailgate and lock actuation are not impeded.

6 Claims, 2 Drawing Sheets

(56) References Cited

U.S. PATENT DOCUMENTS

| | | | | |
|---|---|---|---|---|
| 8,413,298 | B2 * | 4/2013 | Domenig | E05F 5/02 16/85 |
| 8,468,652 | B2 * | 6/2013 | Salice | F16F 9/19 16/286 |
| 2002/0010977 | A1 * | 1/2002 | Salice | E05F 5/02 16/49 |
| 2003/0173165 | A1 | 9/2003 | Muller et al. | |
| 2007/0108785 | A1 | 5/2007 | Reischer et al. | |
| 2007/0271732 | A1 * | 11/2007 | Bantle | E05F 5/02 16/84 |
| 2008/0265729 | A1 * | 10/2008 | Netzer | A47B 88/04 312/330.1 |
| 2009/0247335 | A1 * | 10/2009 | Mori | F16H 7/0836 474/110 |
| 2010/0212109 | A1 * | 8/2010 | Kim | E05F 5/006 16/85 |

* cited by examiner

OPENING APPARATUS FOR A TAILGATE OF A MOTOR VEHICLE

CROSS REFERENCE TO RELATED APPLICATION

This application claims priority under 35 USC 119 to German Patent Appl. No. 10 2015 100 978.1 filed on Jan. 23, 2015, the entire disclosure of which is incorporated herein by reference.

BACKGROUND

1. Field of the Invention

The invention relates to an opening apparatus for a tailgate of a motor vehicle.

2. Description of the Related Art

DE 10 2011 053 331 A1 discloses an ejection device for a lid of a motor vehicle. The lid can be adjusted by a spring force from a lowered closed position into an open position. Damping elements are arranged in the ejection device and act as both rotational and linear dampers.

It is an object of the invention to provide an opening apparatus for a tailgate of a motor vehicle that suppresses overshooting of the tailgate after opening.

SUMMARY

The invention relates to a tailgate that is braked in its upward movement during folding up or during opening to suppress overshooting. To this end, a compression spring element is arranged between the functional housing and an actuating piston of an opener so that the compression spring is prestressed in the closed position of the tailgate. The actuating piston comprises a force-transmitting toothed segment that is in engagement in a positively locking manner with a gearwheel of a silicone brake so that the silicone brake acts as a damping means in the opening direction of the tailgate and acts as a decoupling freewheel in the closing direction of the tailgate. As a result, a damping action and a freedom of movement are brought about when closing of the tailgate, without impeding the closing actuation.

The toothed segment may be arranged to extend axially on the actuating piston. In a corresponding manner, the gearwheel of the silicone brake and of the freewheel is arranged on a horizontally extending rotational axis and is in meshing engagement with the toothed segment.

The silicone brake damps the opener by way of the compression spring element during extension of the opener and opening of the tailgate. As a result, the tailgate cannot be accelerated freely as a result of the stressed compression spring and comes to a standstill immediately at the end of the opening stroke. In contrast, a freewheel in the silicone brake decouples the silicone brake during closing of the tailgate so as not to impede the lid lock during closing.

The extendable actuating piston of the opening apparatus may have an anti-rotation protection means to ensure that the extending actuating piston cannot rotate.

A latching means may be arranged on the end side of the actuating piston for adjusting the height of the tailgate. The latching means may have an axial toothing system that is guided in a corresponding receptacle of the actuating piston. As a result, the tailgate can be set with respect to the vehicle body within certain limits.

The actuating piston may have a rubber buffer supported on the vehicle body and adjoining the latching means to support the actuating piston on the vehicle body. The rubber buffer is arranged in the tailgate in the closed position and can project slightly.

One exemplary embodiment of the invention is shown in the drawings and will be described in greater detail in the following text.

DETAILED DESCRIPTION

Figure 1:
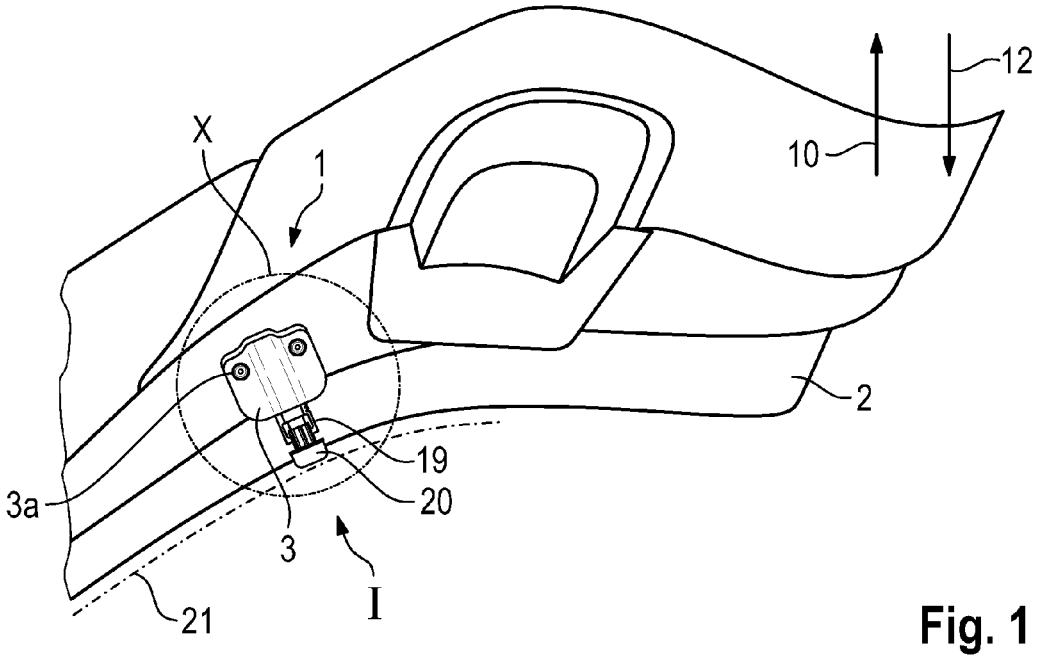
FIG. 1 is a view of the installation location of the opening apparatus on one side of the tailgate of a motor vehicle.
Figure 2:
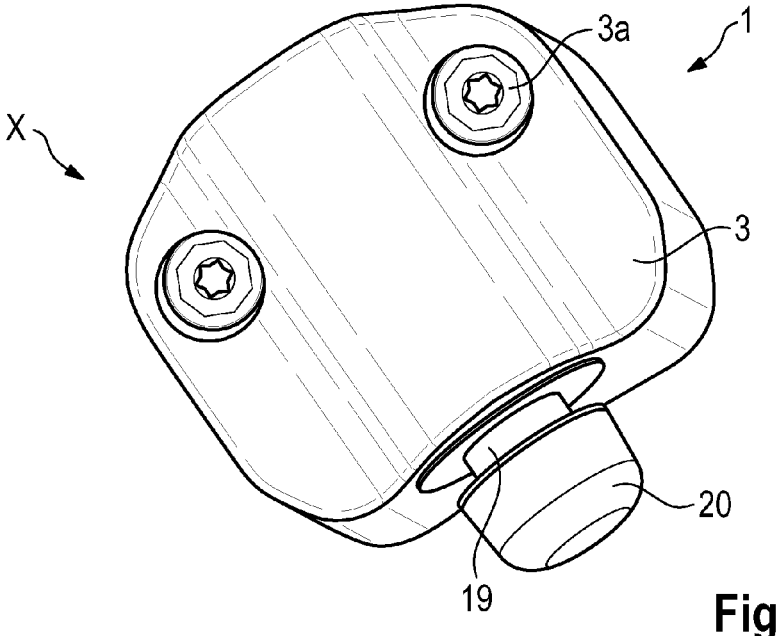
FIG. 2 is an outer view x according to FIG. 1 of the opening apparatus.

An opening apparatus 1 for a tailgate 2 of a motor vehicle comprises a functional housing 3 that is held in a stationary manner on the tailgate 2 via fastenings 3*a*. A compression spring element 4 is arranged in the functional housing 3 and is held prestressed in a closed position I of the tailgate 2. The compression spring element 4 is connected in a pressure-loaded manner to an opener 5.

Figure 3:
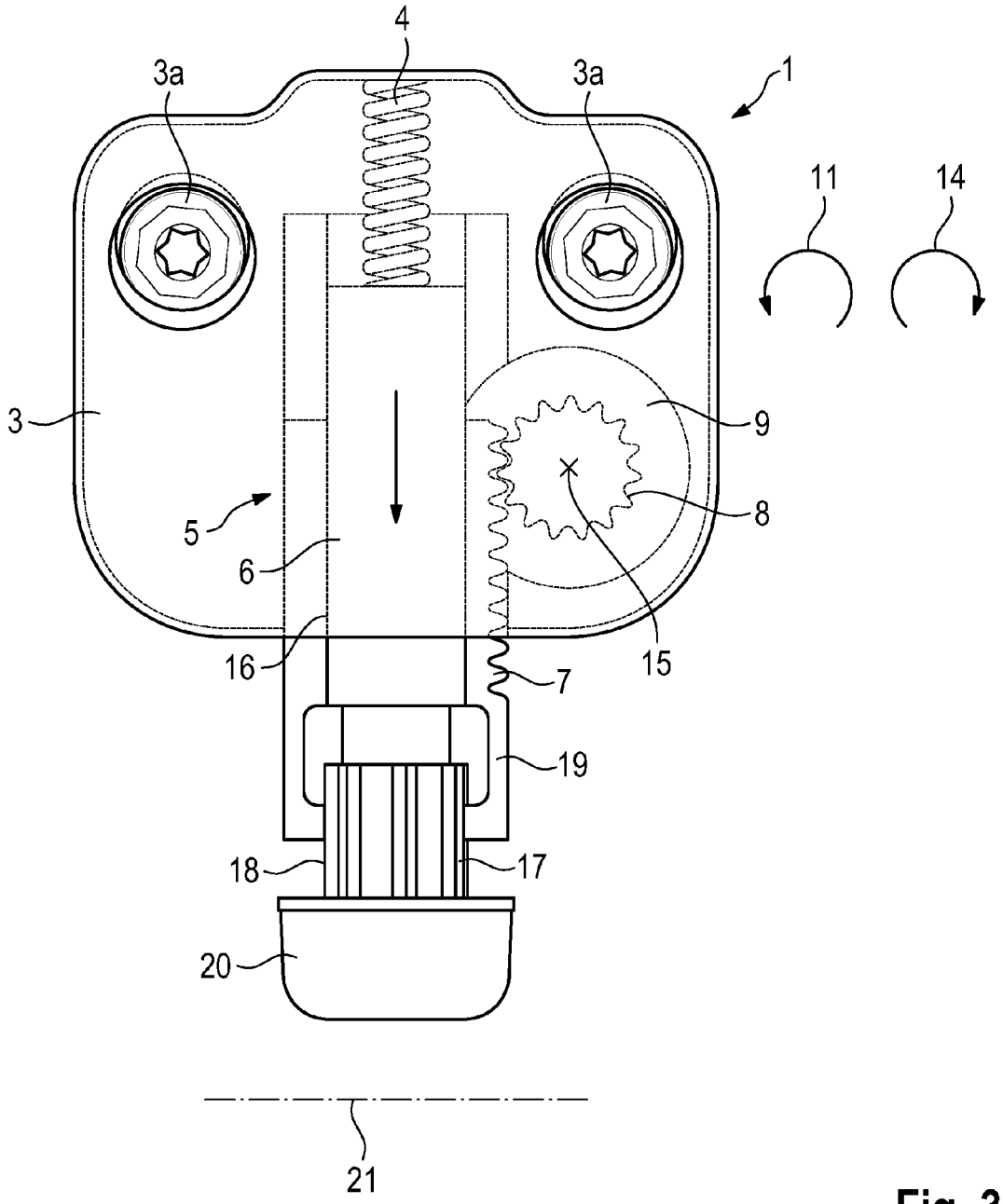
FIG. 3 is a vertical section through the opening apparatus in the extended position of the tailgate with silicone brake and an integrated freewheel.

The compression spring element 4 is prestressed between the functional housing 3 and an actuating piston 6 of the opener 5 in the closed position I of the tailgate 2 and is relieved during opening of the tailgate 2. The actuating piston 6 comprises a force-transmitting toothed segment 7 that is in positively locking engagement with a gearwheel 8 of a silicone brake 9. This causes a damping action in the arrow direction 11 to act in the opening direction 10 of the tailgate 2 and a decoupling freewheel in the arrow direction 14 to act in the closed position I of the tailgate 2. The corresponding arrow directions 11 and 14 for the damping action and the freewheel are shown in greater detail in FIG. 3.

The toothed segment 7 extends axially on the actuating piston 6. To this end, the gearwheel 8 of the silicone brake 9 is arranged on a horizontal rotational axis 15 and is in meshing engagement with the gearwheel 8.

The extending actuating piston 6 has an anti-rotation protection means 16, such as at least one axially extending element that suppresses rotational adjustment of the actuating piston 6.

A latching means 17 for a height adjustment of the tailgate 2 is arranged on the end side of the actuating piston 6. The latching means 17 comprises an axial toothing system 18 on an inner telescoping component at the lower end of the piston 6 that is guided adjustably in a corresponding receptacle 19 of the actuating piston 6 to vary the length of the actuating piston 6 and hence to adjust the height position of the tailgate 2.

The actuating piston 6 has a rubber buffer 20 that adjoins the latching means 17 and that is supported on the vehicle body 21.

What is claimed is:

1. An opening apparatus for a tailgate of a motor vehicle, the tailgate being movable between a closed position and an open position relative to a vehicle body of the motor vehicle, the opening apparatus comprising: a housing fixedly mounted on the tailgate; an actuating piston having a first end in the housing and a second end projecting from the housing and contacting the vehicle body when the tailgate is in the closed position, the actuating piston being movable in the housing so that a projecting distance of the second end from the housing is variable; a compression spring element disposed in the housing and biasing the actuating piston in a direction to increase a projecting distance of the second end of the actuating piston from the housing, the compression spring element being prestressed in the closed position of the tailgate, the actuating piston having a force-transmitting toothed segment; and a silicone brake having a gearwheel that is in engagement in a positively locking manner with the toothed segment of the actuating piston, the silicone brake being configured to act as a damping means when the compression coil spring is biasing the actuating piston out of the housing and to act as a decoupling freewheel when the actuating piston is being urged into the housing.

2. The opening apparatus of claim 1, wherein the toothed segment is arranged on the actuating piston so as to extend axially on the actuating piston and the gearwheel is arranged on a rotational axis normal to the actuating piston and is in meshing engagement with the toothed segment.

3. The opening apparatus of claim 1, wherein the actuating piston of the opening apparatus has an anti-rotation protection means for preventing rotation of the actuating piston relative to the housing.

4. The opening apparatus of claim 1, further comprising a latching means for adjusting a height of the tailgate, the latching means being arranged on in proximity to the second end of the actuating piston, and having an axial toothing system that is guided in a receptacle of the actuating piston.

5. The opening apparatus of claim 4, further comprising a rubber buffer adjoining the latching means and supported on the vehicle body in the closed position of the tailgate and during opening of the tailgate.

6. A motor vehicle, comprising:

a body;

a tailgate that movable between a closed position and an open position relative the body of the motor vehicle; and an opening apparatus that includes:

a housing fixedly mounted on the tailgate;

an actuating piston having a first end in the housing and a second end projecting from the housing and contacting the vehicle body when the tailgate is in the closed position, the actuating piston being movable in the housing so that a projecting distance of the second end from the housing is variable;

a compression spring element disposed in the housing and biasing the actuating piston in a direction to increase a projecting distance of the second end of the actuating piston from the housing, the compression spring element being prestressed in the closed position of the tailgate, the actuating piston having a force-transmitting toothed segment; and a silicone brake having a gearwheel that is in engagement in a positively locking manner with the toothed segment of the actuating piston, the silicone brake being configured to act as a damping means when the compression coil spring is biasing the actuating piston out of the housing and to act as a decoupling freewheel when the actuating piston is being urged into the housing.

* * * * *